US009164476B2

(12) United States Patent
Chadani et al.

(10) Patent No.: US 9,164,476 B2
(45) Date of Patent: Oct. 20, 2015

(54) TONER CARTRIDGE HAVING STRUCTURE FOR MINIMIZING DEFORMATION WHEN GRIPPED

(75) Inventors: Kazuo Chadani, Suntou-gun (JP); Tomonori Mori, Numazu (JP); Shuichi Gofuku, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 119 days.

(21) Appl. No.: 13/525,647

(22) Filed: Jun. 18, 2012

(65) Prior Publication Data

US 2012/0328324 A1 Dec. 27, 2012

(30) Foreign Application Priority Data

Jun. 21, 2011 (JP) ..... 2011-137418
Jun. 6, 2012 (JP) ..... 2012-128948

(51) Int. Cl.
*G03G 21/16* (2006.01)
*G03G 21/18* (2006.01)

(52) U.S. Cl.
CPC ..... *G03G 21/1896* (2013.01); *G03G 21/1814* (2013.01); *G03G 21/1828* (2013.01); *G03G 21/1825* (2013.01); *G03G 21/1839* (2013.01); *G03G 2215/0695* (2013.01)

(58) Field of Classification Search
CPC ..... G03G 21/1803; G03G 21/1814
USPC ..... 399/111
See application file for complete search history.

(56) References Cited

U.S. PATENT DOCUMENTS

| | | | | |
|---|---|---|---|---|
| 5,206,619 | A * | 4/1993 | Kita | 399/111 |
| 6,118,958 | A * | 9/2000 | Nagashima | 399/105 |
| 6,363,233 | B1 * | 3/2002 | Nakajima | 399/120 |
| 7,024,134 | B2 | 4/2006 | Yokomori et al. | |
| 2001/0055494 | A1 * | 12/2001 | Katakabe et al. | 399/27 |
| 2005/0002684 | A1 * | 1/2005 | Suzuki | 399/109 |
| 2005/0141915 | A1 * | 6/2005 | Okamoto | 399/103 |

FOREIGN PATENT DOCUMENTS

JP 2005-043537 A 2/2005

OTHER PUBLICATIONS

Office Action in Chinese Patent Application No. 201210211537.3, dated Mar. 26, 2014.

* cited by examiner

*Primary Examiner* — Benjamin Schmitt
(74) *Attorney, Agent, or Firm* — Fitzpatrick, Cella, Harper & Scinto

(57) ABSTRACT

A cartridge detachably mountable to a main assembly of an image forming apparatus includes an accommodating portion for accommodating a developer, a recess provided in an outer wall of a frame for forming the accommodating portion, and a sheet member provided so as to cover the recess. The sheet member and the recess are configured so that an amount of flexure of the sheet member is larger than that of the recess when the cartridge is gripped at the sheet member.

21 Claims, 13 Drawing Sheets

TONER CARTRIDGE HAVING STRUCTURE FOR MINIMIZING DEFORMATION WHEN GRIPPED

FIELD OF THE INVENTION AND RELATED ART

The present invention relates to cartridge for use in an electrophotographic image forming apparatus.

In a conventional electrophotographic image forming apparatus, a process cartridge type in which an electrophotographic photosensitive drum and process means acting on the electrophotographic photosensitive drum are integrally assembled into a cartridge (unit) which is detachably mountable to a main assembly of the electrophotographic image forming apparatus is employed. According to this process cartridge type, a user can perform maintenance of the apparatus by himself (herself) without relying on a service person. For that reason, the process cartridge type has been widely used in the electrophotographic image forming apparatus.

An image forming operation of the image forming apparatus is performed in the following manner. First, the electrophotographic photosensitive drum is irradiated with light, corresponding to image information, emitted from a laser, an LED, a lamp or the like. As a result, an electrostatic latent image is formed on the photosensitive drum. Then, this electrostatic latent image is developed with a toner (developer) by a developing device. Further, a toner image formed on the photosensitive drum is transferred onto a recording material. Then, by a cleaning member contacted to the photosensitive drum, a transfer residual toner which is the toner remaining on the photosensitive drum after the transfer is removed.

Here, the removed transfer residual toner is accommodated in a removed toner chamber (developer accommodating portion) but when the user strongly grips the removed toner chamber, there is a possibility that the removed toner chamber is deformed to cause leakage of the removed toner. For this reason, there is a constitution in which a rib member for preventing the deformation is provided (e.g., Japanese Laid-Open Patent Application (JP-A) 2005-043537).

SUMMARY OF THE INVENTION

The present invention provides further development of the above-described conventional constitution.

A principal object of the present invention is to provide a cartridge capable of preventing leakage of a toner, without providing a rib member at a developer accommodating portion, when a user strongly grips the cartridge.

According to an aspect of the present invention, there is provided a cartridge detachably mountable to a main assembly of an image forming apparatus, comprising: an accommodating portion for accommodating a developer; a recess provided in an outer wall of a frame for forming the accommodating portion; and a sheet member provided so as to cover the recess, wherein the sheet member and the recess are configured so that an amount of flexure of the sheet member is larger than that of the recess when the cartridge is gripped on the sheet member.

According to the present invention, it becomes possible to prevent the toner leakage, without providing the rib member at the developer accommodating portion, when the user strongly grips the cartridge.

These and other objects, features and advantages of the present invention will become more apparent upon a consideration of the following description of the preferred embodiments of the present invention taken in conjunction with the accompanying drawings.

Figure 7:
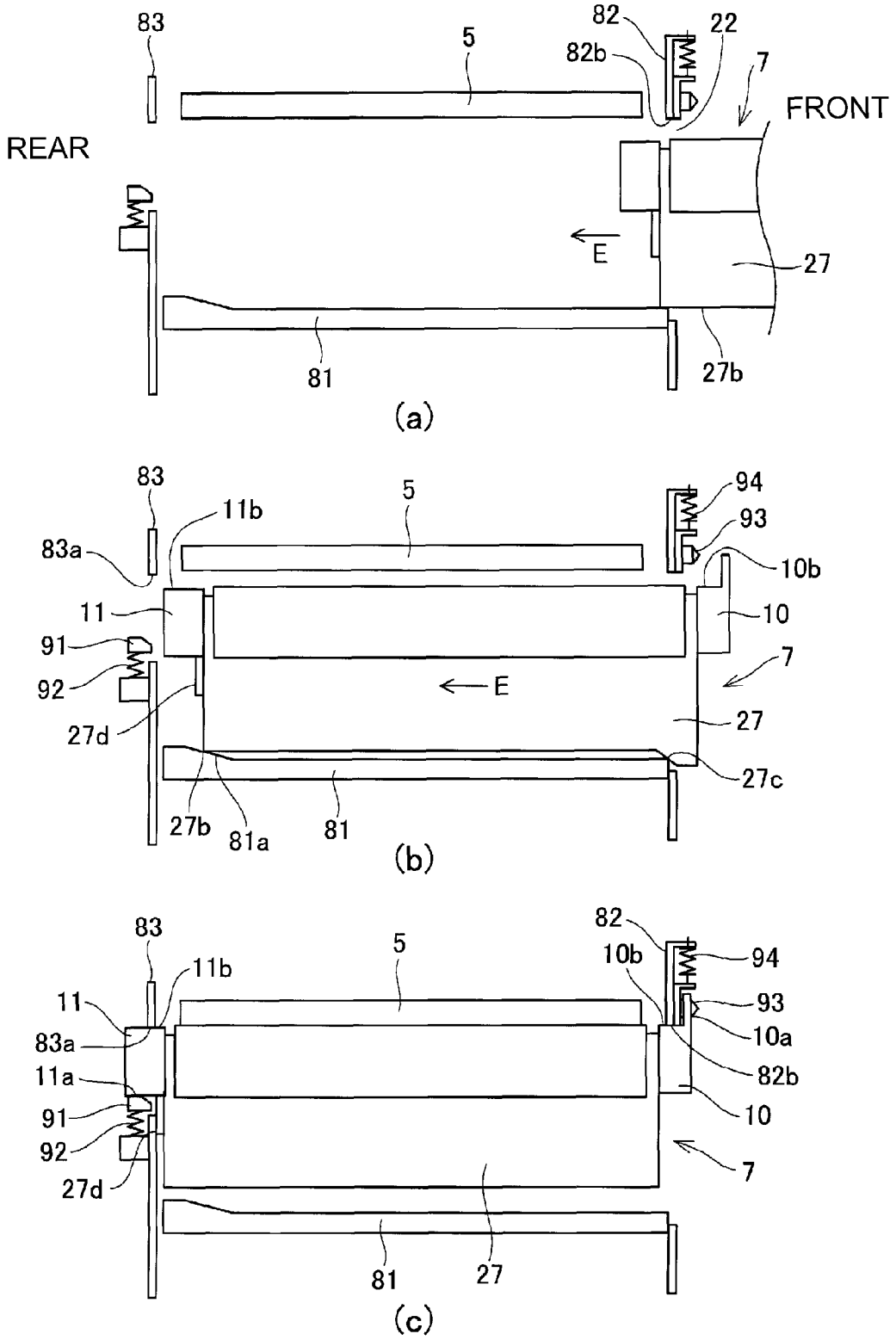

Parts (a), (b) and (c) of FIG. 7 are schematic views for illustrating the case where the process cartridge is mounted in a main assembly of the image forming apparatus.

Figure 8:
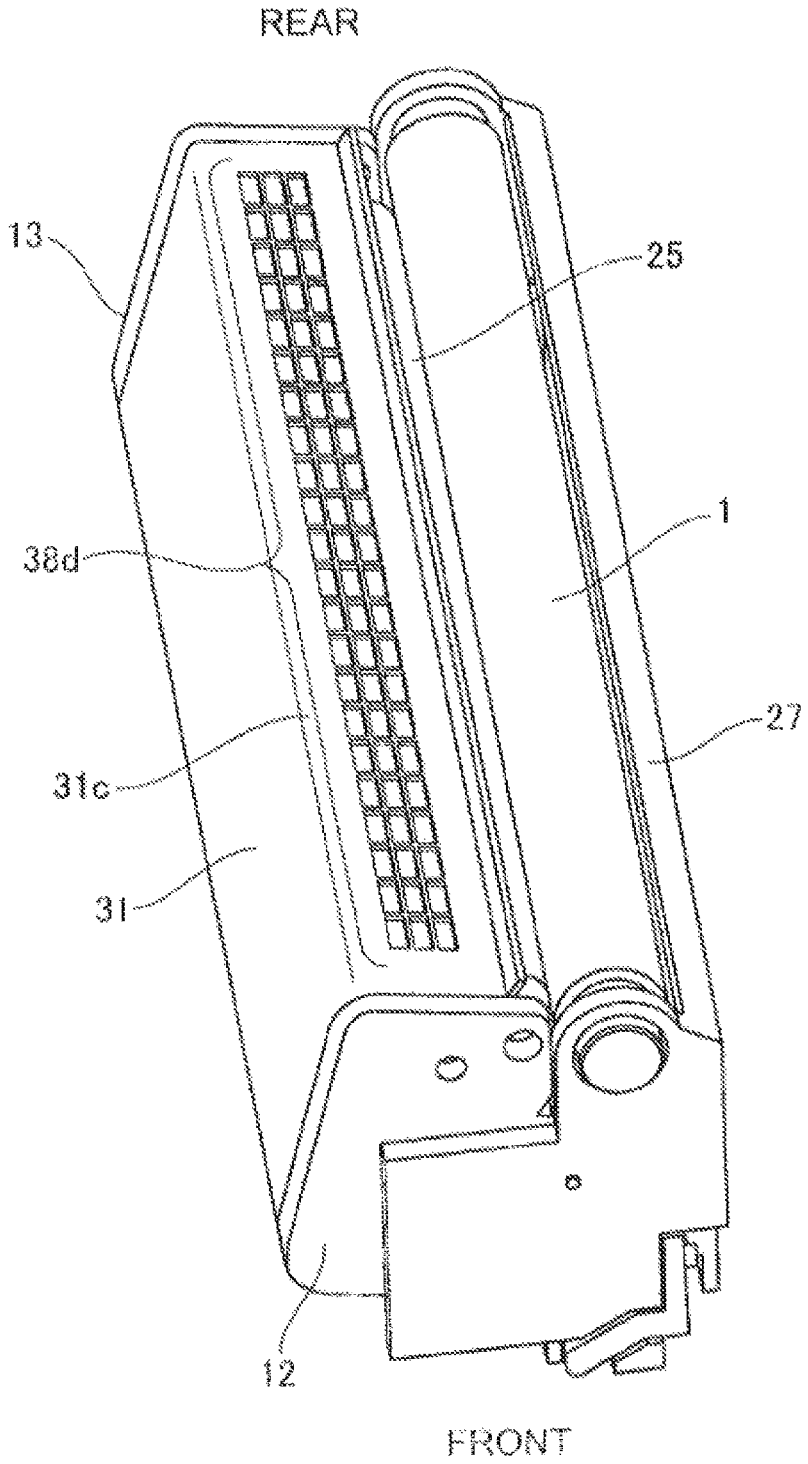
Fig. 8 PRIOR ART

FIG. 8 is a schematic perspective view of a conventional process cartridge.

Figure 9:
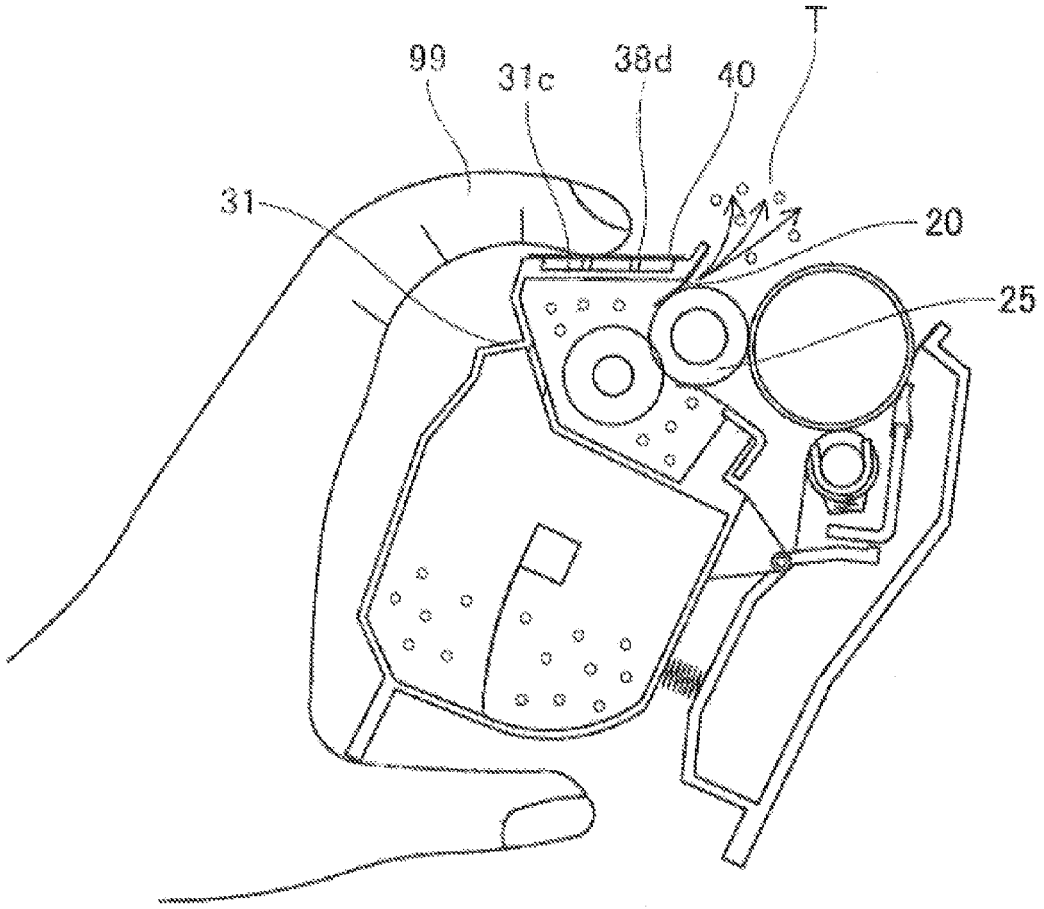
Fig. 9 PRIOR ART

FIG. 9 is a schematic view showing a state in which a user grips the conventional process cartridge.

Figure 10:
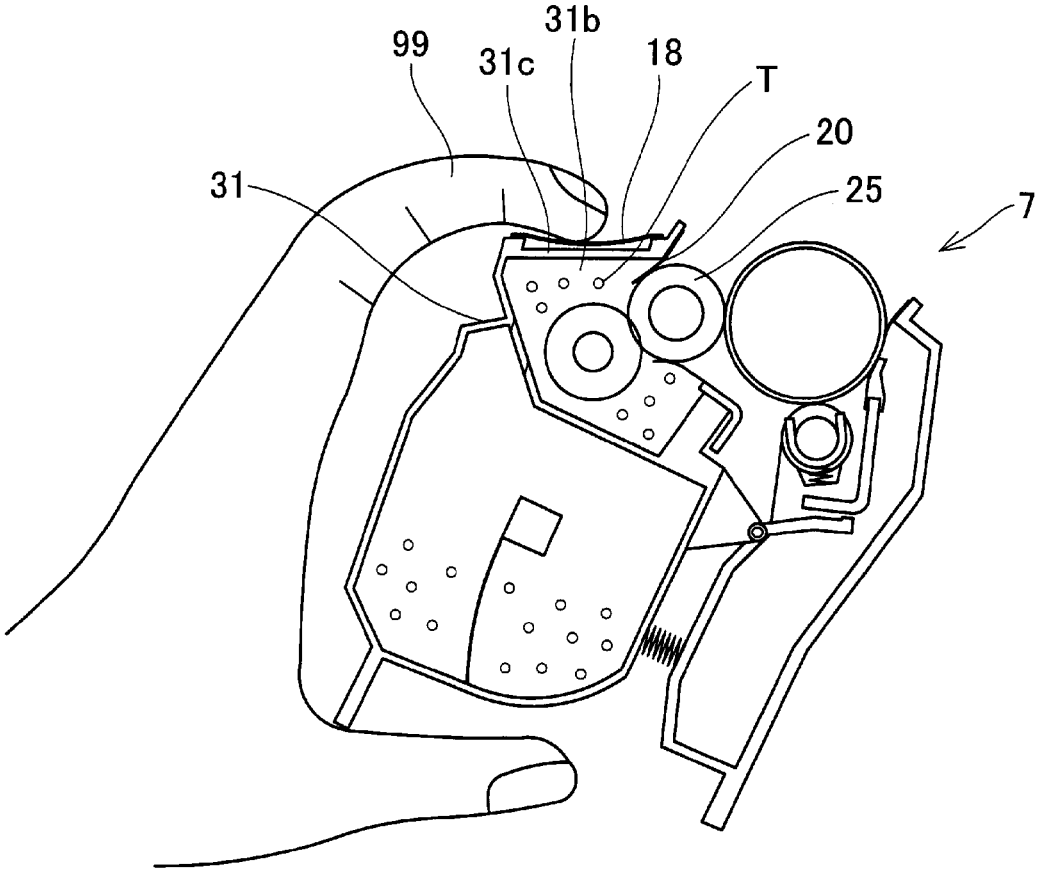

FIG. 10 is a schematic view showing a state in which the user grips the process cartridge in the embodiment.

Figure 11:
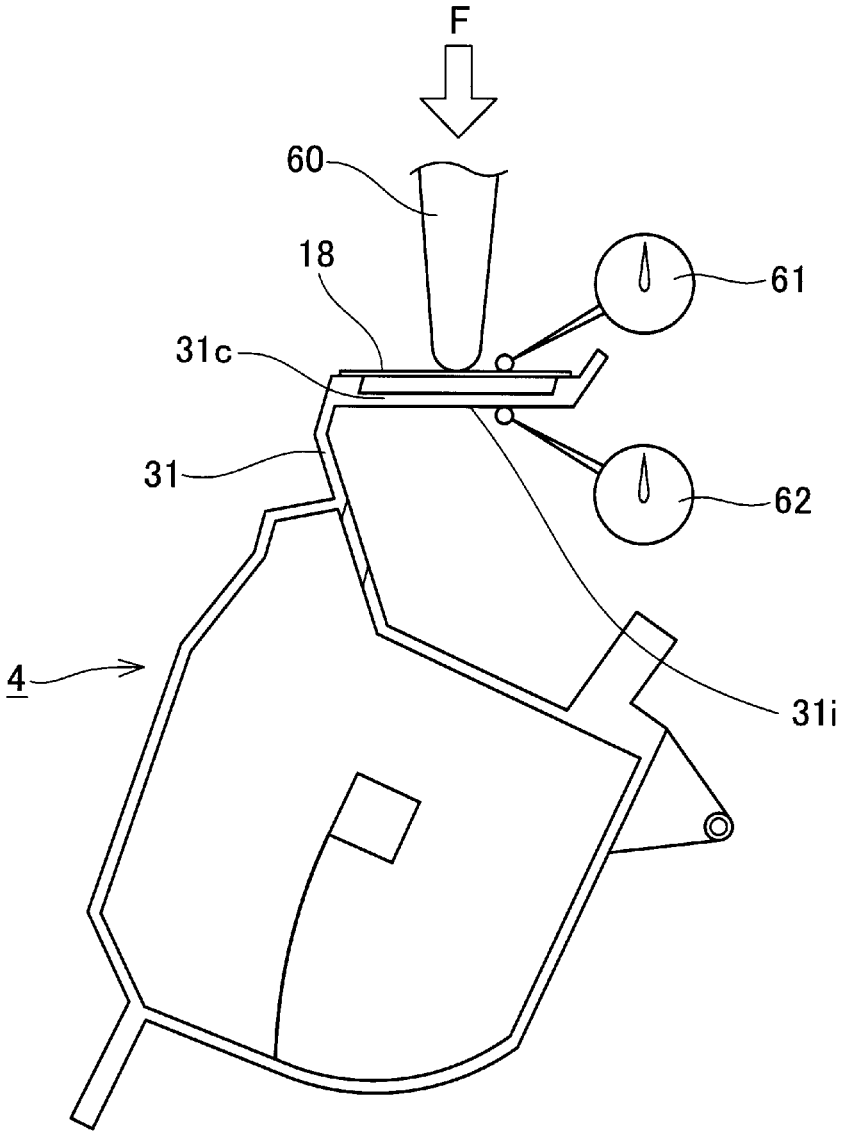
Figure 12:
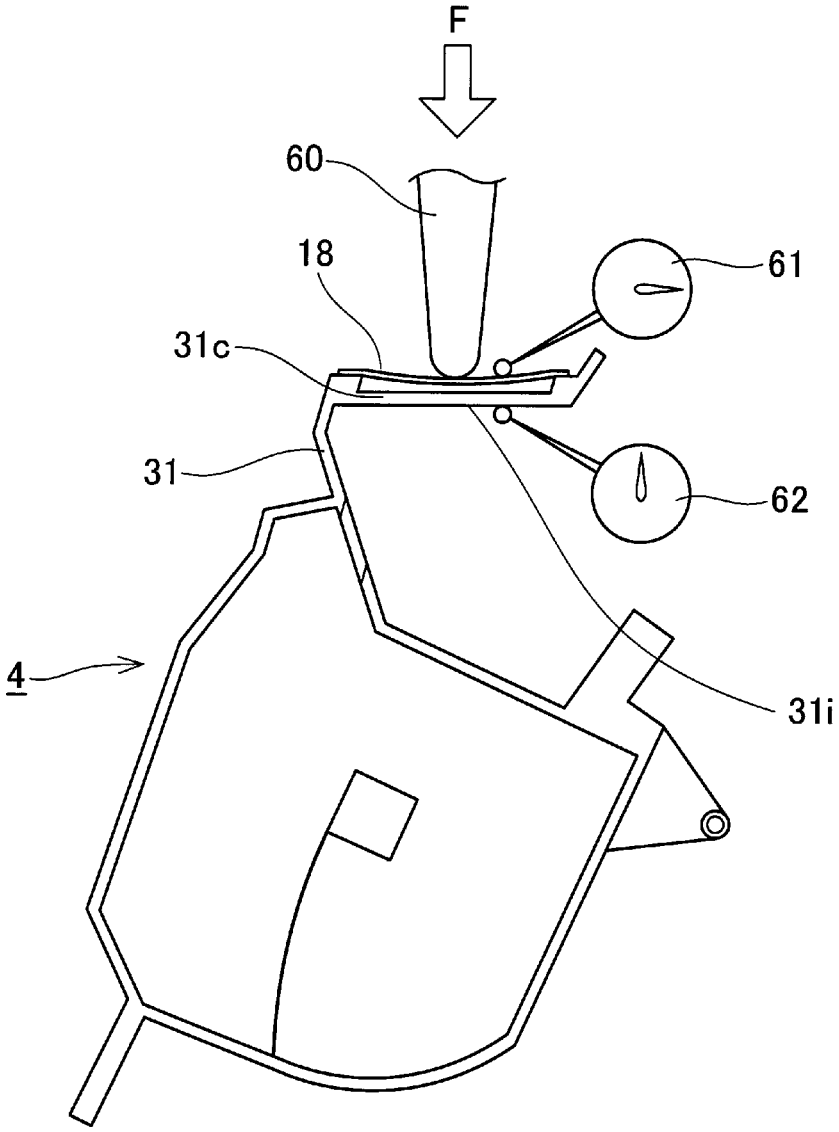

FIGS. 11 and 12 are schematic views for illustrating a measuring method of an amount of deformation of each of a developing sheet and an outer wall surface.

Figure 13:
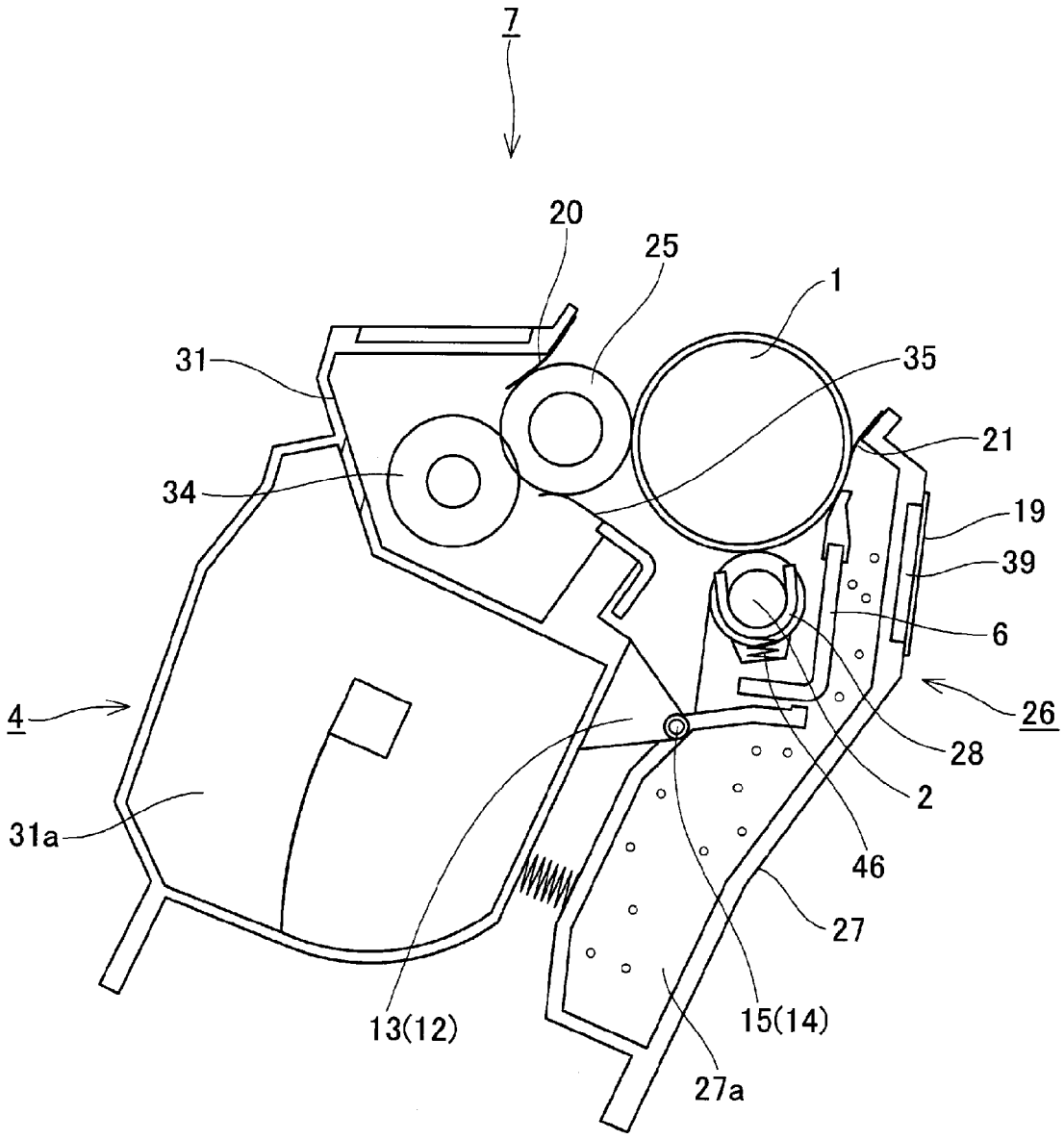

FIG. 13 is a schematic sectional view of a process cartridge in another embodiment.

DESCRIPTION OF THE PREFERRED EMBODIMENTS

Hereinbelow, embodiments for carrying out the present invention will be exemplarily and specifically described with reference to the drawings. However, dimensions, materials, shapes, relative arrangements and the like of constituent elements described in the following embodiments are appropriately changed depending on constitutions or various conditions of devices (apparatuses) to which the present invention is applied and thus the scope of the present invention is not limited thereto.

The present invention relates to a cartridge used in an electrophotographic image forming apparatus. Here, the electrophotographic image forming apparatus forms an image on a recording material by using an electrophotographic image forming method (process). Examples of the electrophotographic image forming apparatus may include an electrophotographic copying machine, an electrophotographic printer (such as a laser beam printer or an LED printer), a facsimile machine and a word processor. Further, the cartridge may preferably be prepared by integrally assembling an image bearing member and at least one of a developing means and a cleaning means, which are process means acting on the image bearing member, into a unit (cartridge) which is detachably mountable to a main assembly of the image forming apparatus. Further, the developing means or the cleaning means may also be assembled into a unit (cartridge) which is detachably mountable to the main assembly of the image forming apparatus.

An embodiment of the present invention will be described below.

(General Structure of Image Forming Apparatus)

First, a general structure of an electrophotographic image forming apparatus 100 will be described with reference to FIG. 2.

Figure 2:
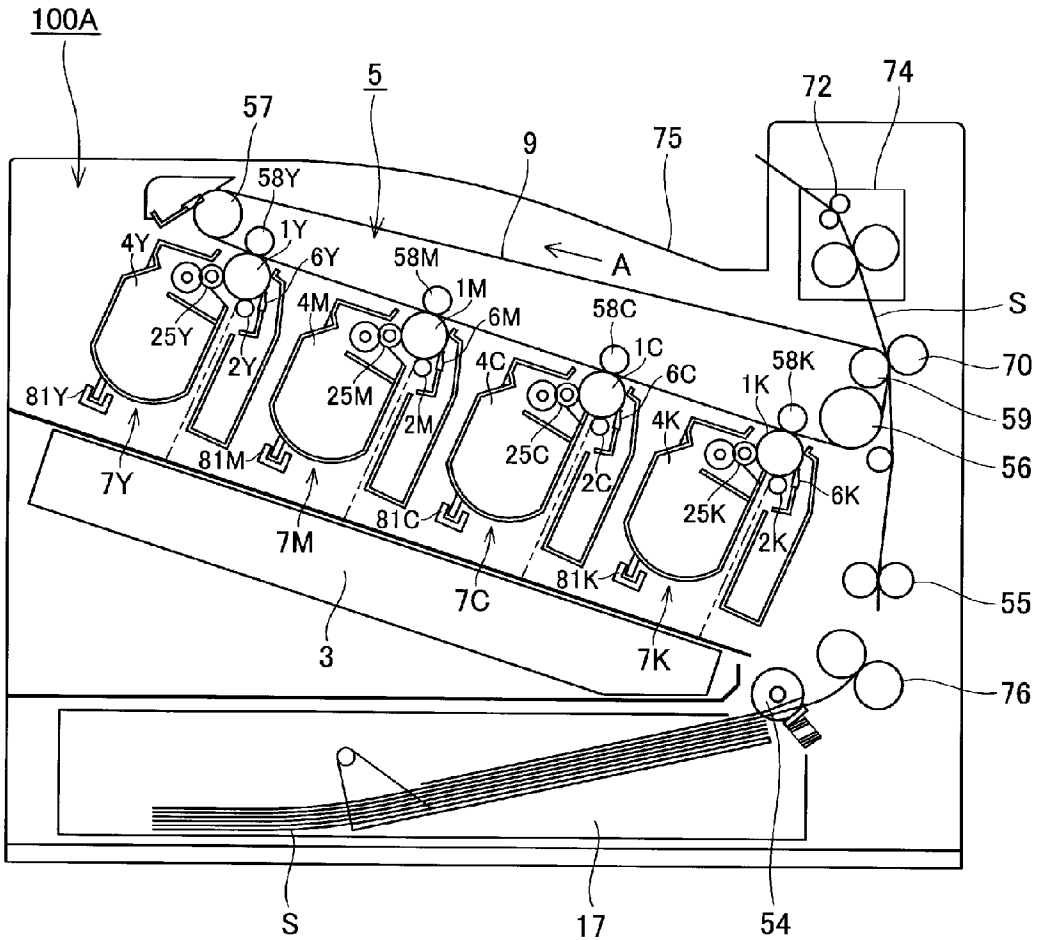
FIG. 2 is a schematic sectional view of a process cartridge in which a toner is accommodated in the embodiment.

FIG. 2 is a sectional view showing a schematic structure of the image forming apparatus in this embodiment. As shown in FIG. 2, four process cartridges 7 (7Y, 7M, 7C, 7K) are detachably mounted in the image forming apparatus 100 by a mounting member (not shown). In FIG. 2, the process cartridges 7 are, in a disposition state of the image forming apparatus 100, juxtaposed and inclined with respect to the horizontal direction in a main assembly 100A of the image forming apparatus 100 (hereinafter referred to as an apparatus main assembly 100A).

Here, in this embodiment, with respect to the apparatus main assembly 100, an upstream side of a mounting direction of the process cartridge 7 is defined as a front (side-surface) side, and a downstream side of the mounting direction of the process cartridge 7 is defined as a rear (side-surface) side. Further, the mounting direction of the process cartridge 7 to the apparatus main assembly 100A (in this embodiment, the mounting direction is the same direction as a rotational axis direction of a photosensitive drum 1 or a developing roller (developer carrying member) 25) is also referred to as a longitudinal direction. Further, in the disposition state of the apparatus main assembly 100A, the vertical direction is referred to as an up-down direction.

Further, structures and operations of the respective process cartridges and transfer means are substantially the same except for colors of developers (toners), used for the contacts and transfer means, different from each other. Therefore, in the following description, in the case where, there is no need to particularly differentiate the colors, suffixes Y, M, C and K added to referential numerals or symbols for representing elements (means) provided for associated colors in FIG. 2 are omitted and will be collectively described.

In each of the process cartridges 7, an electrophotographic photosensitive drum 1 and process means, provided around the photosensitive drum 1, including a charging roller 2, a developing roller 25, a cleaning member 6 and the like are integrally provided. The charging roller 2 electrically charges the surface of the photosensitive drum 1 uniformly, and the developing roller 25 develops a latent image, formed on the photosensitive drum 1, with a toner to visualize the latent image. Further, the cleaning member 6 removes the toner remaining on the photosensitive drum 1 after a toner image (developer image) formed on the photosensitive drum 1 is transferred onto a recording material.

Further, below the process cartridges 7, a scanner unit 3 for forming the latent image on the photosensitive drums 1 by subjecting the photosensitive drums 1 to selective exposure to light on the basis of image information is provided.

At a lower portion of the apparatus main assembly 100A, a cassette 17 in which sheets of the recording material S are accommodated is mounted. Further, a recording material conveying means is provided so that the recording material S can be conveyed to an upper portion of the apparatus main assembly 100A by being passed through a secondary transfer roller 70 and a fixing portion 74. That is, a feeding roller 54 for separating and feeding the sheets of the recording material S in the cassette 17 in a one-by-one manner, a conveying roller pair 76 for conveying the fed recording material S, and a registration roller pair 55 for synchronizing the latent image formed on the photosensitive drum 1 with the recording material S are provided.

Further, on the process cartridges 7, an intermediary transfer unit 5 as an intermediary transfer means (primary transfer means) onto which the toner images formed on the photosensitive drums 1 are to be transferred is provided. Inside the intermediary transfer unit 5, a driving roller 56, a follower roller 57, primary transfer rollers 58 opposing the photosensitive drums 1 for the respective colors, and an opposite roller 59 opposing a secondary transfer roller 70 are provided. Around these rollers, a transfer belt (intermediary transfer belt) 9 is extended and stretched.

The transfer belt 9 opposes all of the photosensitive drums 1 and is circulated and moved so as to be contacted to the photosensitive drums 1. Further, in a state in which the transfer belt 9 is circulated and moved, a voltage is applied to the primary transfer roller 58, so that primary transfer of the toner image from the photosensitive drum 1 onto the transfer belt 9 can occur. Then, by voltage application to the secondary transfer roller 70 and the opposite roller 59 disposed inside the transfer belt 9, the toner image is transferred from the transfer belt 9 onto the recording material S.

During image formation, each photosensitive drum 1 is rotated, and then the photosensitive drum 1 uniformly charged by the charging roller 2 is subjected to selective exposure to light emitted from the scanner unit 3. As a result, an electrostatic latent image is formed on the photosensitive drum 1. The latent image is developed by the developing roller 25. As a result, the respective color toner images are formed on the associated photosensitive drums 1, respectively. In synchronism with this image formation, the recording material S is conveyed by the registration roller pair 55 to a secondary transfer position where the secondary transfer roller 70 opposing the opposite roller 59 is contacted to the transfer belt 9.

Then, a transfer bias voltage is applied to the secondary transfer roller 70, so that the respective color toner images are secondary-transferred from the transfer belt 9 onto the recording material S. Thus, a color image is formed on the recording material S. The recording material S on which the color image is formed is heated and pressed, so that the color image (toner images) is fixed on the recording material S. Thereafter, the recording material S is discharged onto a discharge portion 75 by a (sheet-)discharging roller 72. Incidentally, a fixing portion 74 is provided at the upper portion of the apparatus main assembly 100A.

(Process Cartridge)

Next, the process cartridge 7 in this embodiment will be described with reference to FIG. 1 and FIGS. 3 to 5.

Figure 1:
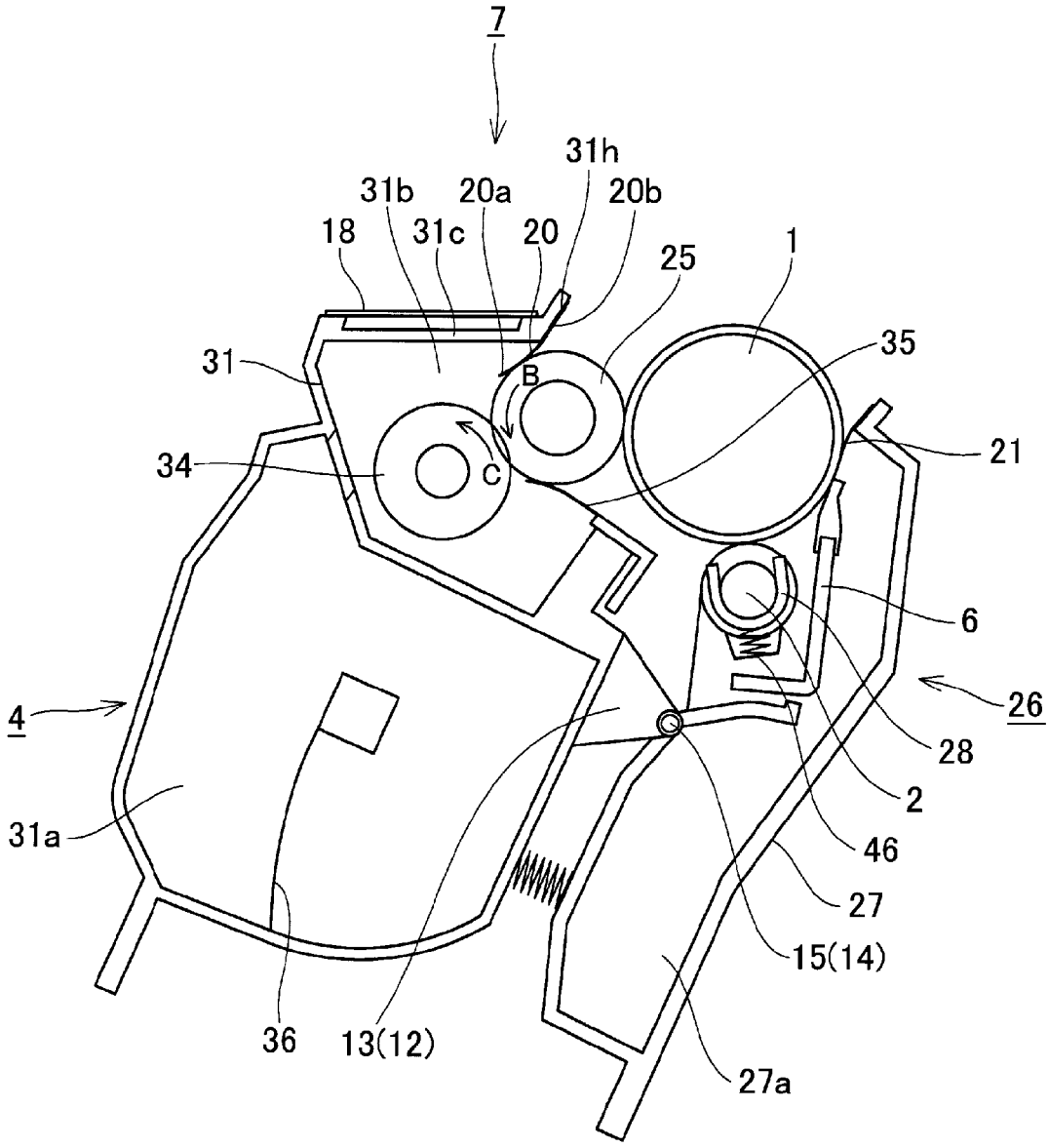
FIG. 1 is a sectional view showing a schematic structure of an image forming apparatus in an embodiment of the present invention.
Figure 3:
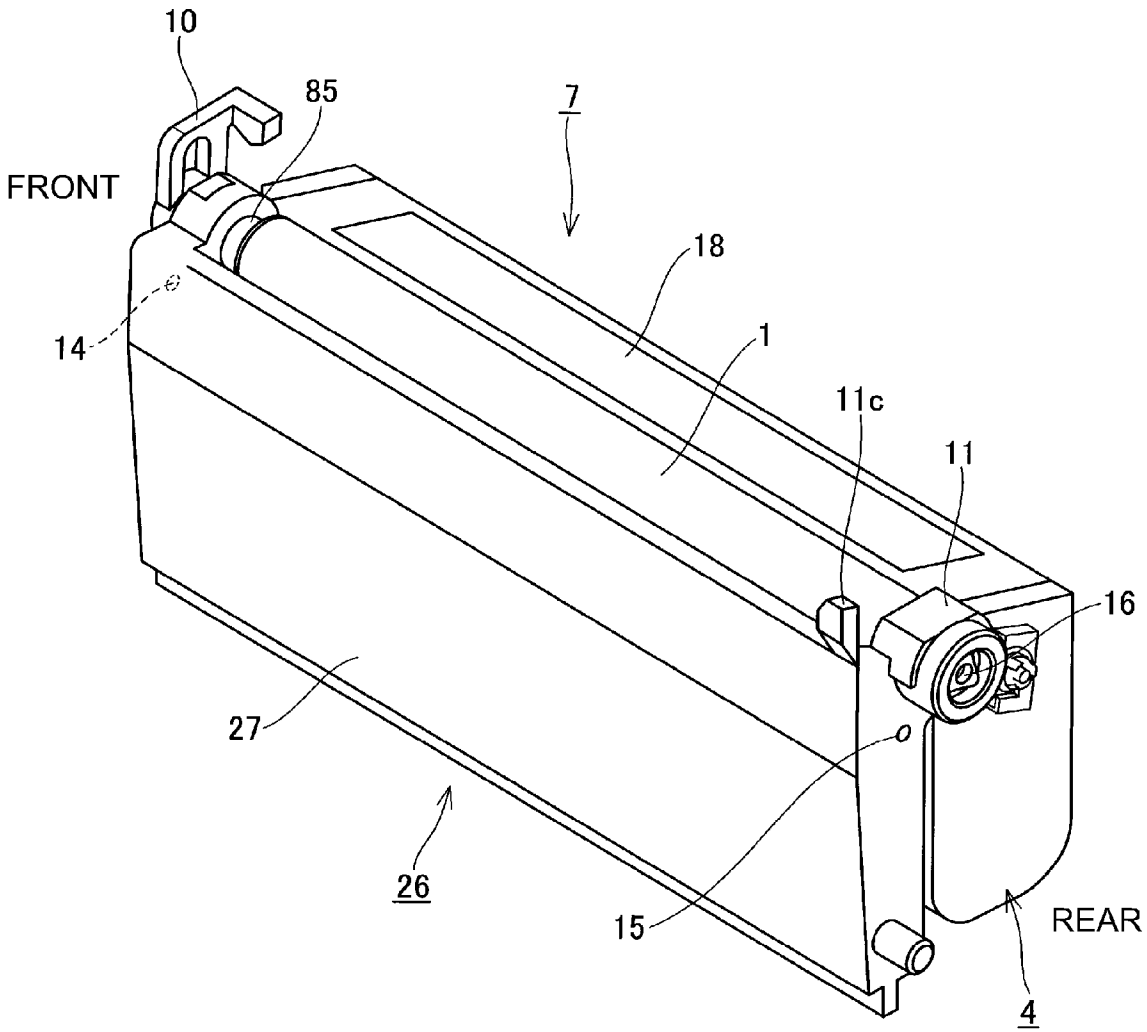
FIGS. 3, 4 and 5 are schematic perspective views of a process cartridge 7 in the embodiment.
Figure 4:
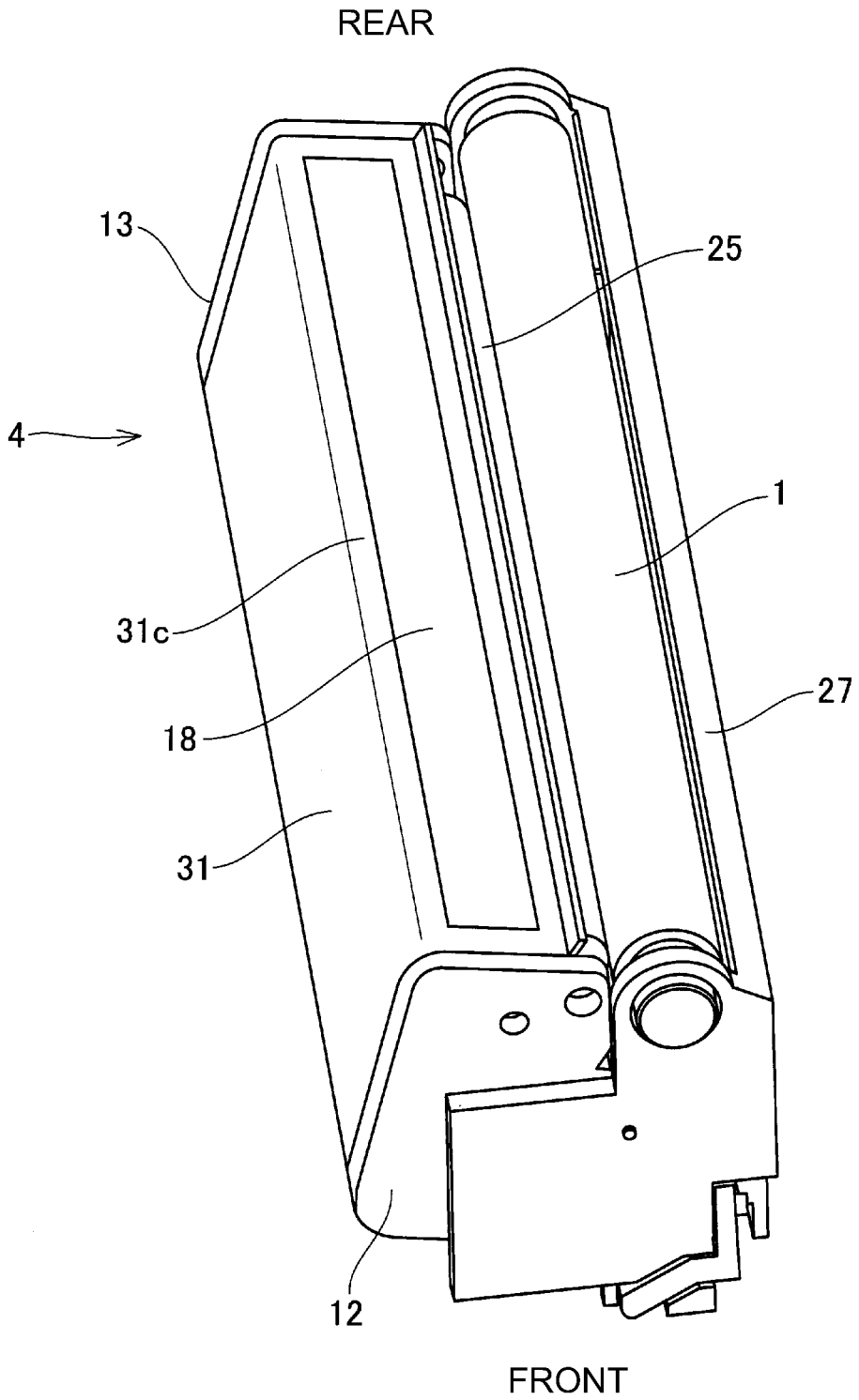
Figure 5:
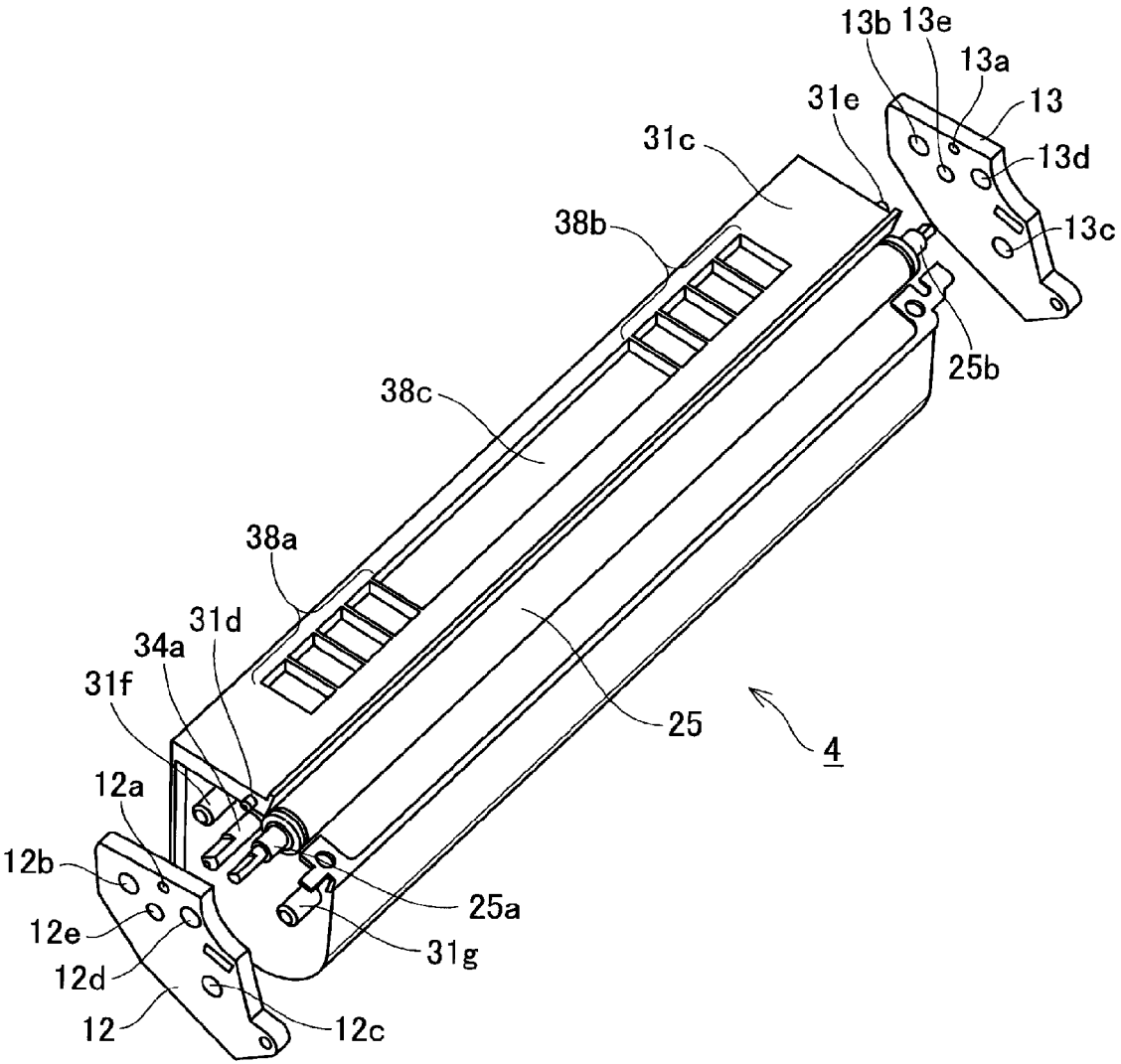

FIG. 1 is a schematic sectional view of the process cartridge 7 in which the toner is accommodated. FIGS. 3 to 5 are schematic perspective views of the process cartridge 7 in this embodiment. As shown in FIG. 1, the process cartridge 7 includes a drum unit 26 (26Y, 26M, 26C, 26K) and a developing unit 4 (4Y, 4M, 4C, 4K) as the developing means.

The drum unit 26 includes the photosensitive drum 1, the charging roller 2 and the cleaning member 6. Further, the developing unit 4 includes the developing roller 25.

On the peripheral surface of the photosensitive drum 1, as described above, the charging roller 2 and the cleaning member 6 are disposed. Further, a residual toner removed from the surface of the photosensitive drum 1 by the cleaning member 6 falls into a removed toner chamber 27*a*. Further, a receptor sheet (drum contact sheet) 21 for preventing leakage of the removed toner in the removed toner chamber 27*a* is provided so as to contact the photosensitive drum 1. Further, a driving force of a main assembly driving motor (not shown) as a driving source is transmitted to the drum unit 26, so that the photosensitive drum 1 is rotationally driven depending on an image forming operation.

The charging roller 2 is rotatably mounted to the drum unit 26 via a charging roller bearing 28 and is urged against the photosensitive drum 1 by a charging roller urging member 46, thus being rotated by the rotation of the photosensitive drum 1.

The developing unit 4 is constituted by the developing roller 26, rotated in contact with the photosensitive drum 1 in an arrow B direction shown in FIG. 1 and a developing device frame 31 for supporting the developing roller 25. The developing roller 25 is rotatably supported by the developing device frame 31 via a front developing means bearing 12 and a rear developing means bearing 13 provided in both sides of the developing device frame 31, respectively (FIG. 5).

Further, around the developing roller 25, a toner supplying roller 34 which is contacted to the developing roller 25 and is rotated in an arrow C direction in FIG. 1, and a developing blade 35 for regulating a toner layer on the developing roller 25 are provided.

Further, a leakage-preventing sheet (developing roller contact sheet) 20 for preventing leakage of the toner from the developing device frame 31 contacted to the developing roller 25 is provided. The leakage-preventing sheet 20 is fixed by a fixing member (e.g., a double-sided tape) on a fixing surface 31*h* of the developing device frame 31 in a side 20*b* opposite from a contact side 20*a* where the leakage-preventing sheet 20 contacts the developing roller 25.

Further, with respect to the developing device frame 31, an outer wall surface (outer wall or end surface) 31*c* for forming (constituting) a developing chamber 31*b* where the developing roller 25 and the toner supplying roller 34 are disposed is formed along the longitudinal direction together with the fixing surface 31*h* for fixing the leakage-preventing sheet 20. Here, the developing chamber 31*b* corresponds to an accommodating portion for accommodating the toner, and the developing roller 25 carries the toner accommodated in the developing chamber 25.

Further, in a toner accommodating chamber 31*a* in the developing device frame 31, a toner feeding member 36 for feeding the toner in the developing chamber 31*b* toward the toner supplying roller 34 while stirring the toner accommodated in the toner accommodating chamber 31*a* is provided. Further, a label 18 indicating a method for mounting the process cartridge 7 in the apparatus main assembly 100A (hereinafter, this label 18 is referred to as a developing sheet 18) is bonded, as a sheet member, to the outer wall surface 31*c*.

As shown in FIG. 3, the developing unit 4 is swingably mounted to the drum unit 26 by a front supporting pin 14 and a rear supporting pin 15 which are press-fitted into the drum unit 26. Further, the cleaning device frame 27 is provided with a front drum bearing 10 and a rear drum bearing 11 which rotatably support the photosensitive drum 1. The rear drum bearing 11 supports a drum coupling 16 coupled to the photosensitive drum 1. Further, the front drum bearing 10 supports a flange 85.

Further, as shown in FIG. 4, the developing unit 4 is provided with the developing device frame 31 and the front and rear developing means bearings 12 and 13 for rotatably supporting the developing roller 25 and the toner supplying roller (not shown). Further, the developing sheet 18 has an adhesive surface over the entire surface on a bonding side where the developing sheet 18 is to be bonded to the outer wall surface 31*c*, so that the developing sheet 18 is bonded to the outer wall surface 31*c* and thus is fixed on the developing device frame 31.

As the developing sheet 18, a flexible member such as a polystyrene sheet or a PET (polyethylene terephthalate) sheet is used. In this embodiment, the developing sheet 18 is used as a display label, such as an operation label, a color label or a discrimination label, by subjecting the polystyrene sheet to printing. The operation label is used for explaining handling (operating method) of the process cartridge 7. The color label is used for indicating color information of the toner in a developer container. The discrimination label is used for indicating discrimination information such as an identification number or the like of the process cartridge 7. Here, the material for the developing sheet 18 is not limited to those described above but may only be required to be a sheet member having flexibility.

FIG. 5 is a schematic perspective view of the developing unit in which the developing sheet is not illustrated. Here, the front developing means bearing 12 is provided with engaging holes 12*d* and 12*e* and the rear developing means bearing 13 is provided with engaging holes 13*d* and 13*e* so that these bearings 12 and 13 can be engaged with core metals 25*a* and 25*b* provided at both ends of the developing roller 25 and core metals 34*a* and 34*b* (34*b* is not shown in FIG. 5) provided at both ends of the developing roller 25. Then, these core metals and the engaging holes are engaged with each other, so that the developing roller 25 and the toner supplying roller 34 are rotatably supported by the front and rear developing means bearings 12 and 13.

Further, at longitudinal both end portions of the outer wall surface 31*c* of the developing device frame 31, bosses 31*d* and 31*e* to be engaged with positioning holes 12*a* and 13*a* provided in the front and rear developing means bearings 12 and 13 are provided.

Further, on both side surface (longitudinal both end surface) walls of the developing device frame 31, bosses 31*f* and 31*b* for being engaged with engaging holes 12*b* and 12*c* of the front developing means bearing 12 are provided (bosses to be engaged with the rear developing means bearing 13 are not illustrated).

Then, these bosses and engaging holes are engaged with each other, so that the front and rear developing means bearings 12 and 13 are fixed on the developing device frame 31.

Therefore, the longitudinal both end portions of the developing device frame 31 are supported by the front and rear developing means bearings 12 and 13 and therefore the longitudinal both end portions of the outer wall surface 31*c* are not readily deformed even when the portions receive a force perpendicular to the outer wall surface 31*c*.

Further, the outer wall surface 31*c* of the developing device frame 31 is provided with a plurality of end portion recesses 38*a* and 38*b* each partitioned by ribs at an end portion with respect to the longitudinal direction of the developing roller 25 and is provided with a central portion recess 38*c* at a central portion. Then, the developing sheet 18 is provided so as to cover these end portion recesses 38*a* and 38*b* and central portion recess 38*c*. Particularly, the developing sheet 18 and the central recess 38*c* are disposed so that the user who mounts and demounts the process cartridge 7 can put fingers on the developing sheet 18 when the process cartridge 7 is mounted in and demounted from the apparatus main assembly 100A.

Here, the central recess 38*c* of the outer wall surface 31*c* has an area, where the developing sheet 18 is not bonded, larger than the end portion recesses 38*a* and 38*b*. Therefore, the developing sheet 18 has the bonding area larger in the end portion recesses 38*a* and 38*b* than in the central recess 38*c*, so that an amount of flexure is smaller in the end portion recesses 38*a* and 38*b* then in the central recess 38*c*.

(Mounting Mechanism of Process Cartridge into Apparatus Main Assembly)

Next, a mounting mechanism for mounting the process cartridge 7 in this embodiment into the apparatus main assembly 100A will be described with reference to FIGS. 6 and 7.

Figure 6:
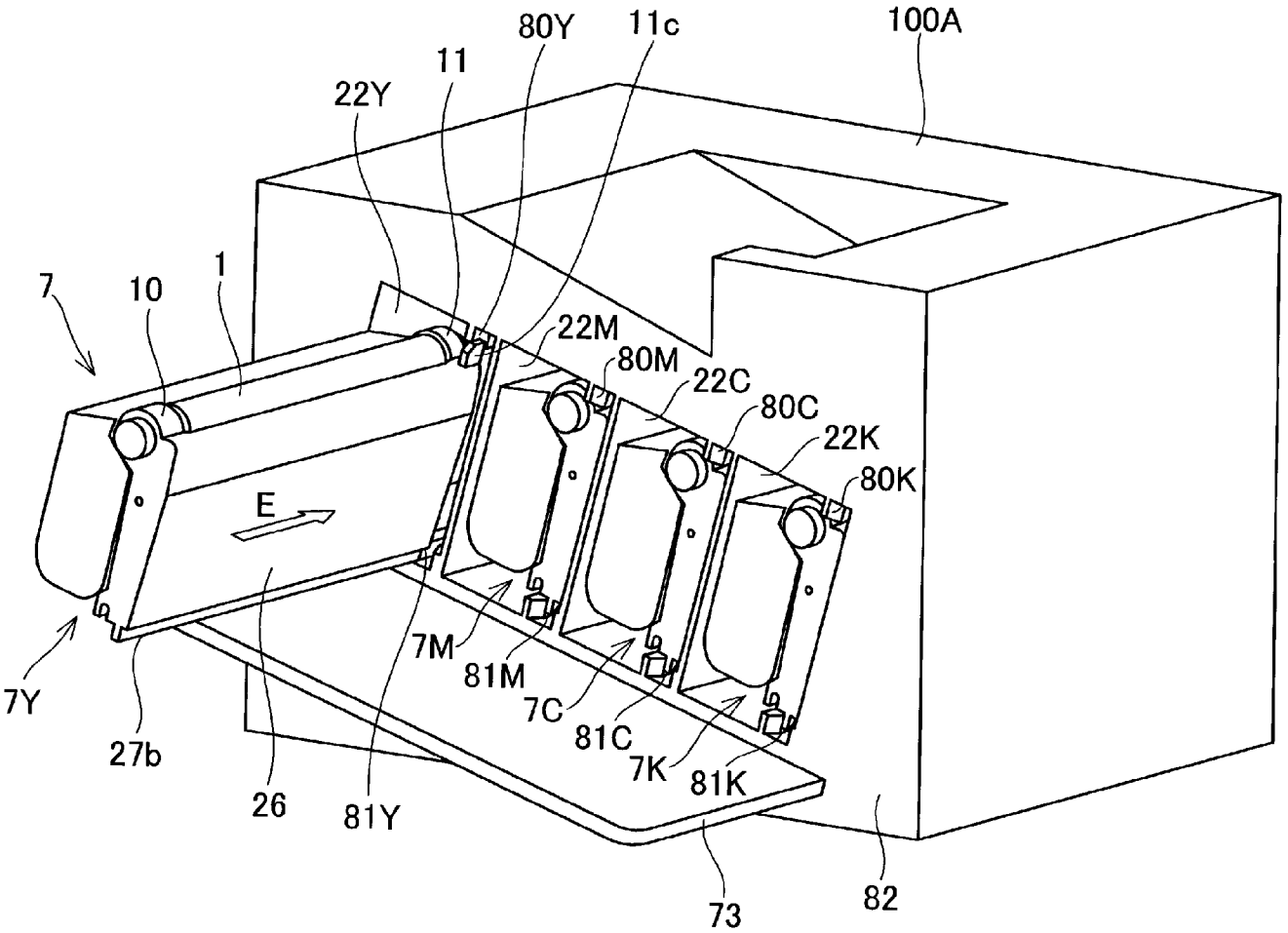
FIG. 6 is a schematic perspective view of the image forming apparatus in the embodiment.

FIG. 6 is a schematic perspective view of the image forming apparatus in this embodiment. In FIG. 6, in a front side of the apparatus main assembly 100A, an openable front cover 73 is provided. When the front cover 73 is opened, mounting portions 22 (22Y to 22K) of the four process cartridges 7 (7Y to 7K) juxtaposed obliquely with respect to the horizontal direction are exposed.

In upper and lower sides of each mount portion 22, an upper mounting guide 80 (80Y to 80K) and a lower mounting guide 81 (81Y to 81K) are provided, respectively.

Then, in a state in which an upper guide portion 11*c* provided on the rear drum bearing 11 of the cleaning device frame 27 is engaged with the upper mounting guide 80 of the apparatus main assembly 100A, the process cartridge 7 is inserted in an arrow E direction in FIG. 6. Similarly, the lower guide portion 27*b* provided on the drum unit 26 is pushed in the arrow E direction in FIG. 6 in a state in which it is engaged with the lower mounting guide 81 of the apparatus main assembly 100A.

Incidentally, the upper guide portion 11*c* is disposed above the process cartridge 7 in the rear side. Further, the lower guide portion 27*b* is disposed at the bottom of the cartridge 7 while extending from the front side to rear side of the process cartridge 7.

Part (a) of FIG. 7 is a schematic view for illustrating a state before the process cartridge 7 is mounted in the apparatus main assembly 100A.

As shown in (a) of FIG. 7, the process cartridge 7 is mounted with respect to the arrow E direction by the mounting portion 22 provided on the front side plate 82 of the apparatus main assembly 100A. At that time, the process cartridge 7 is mounted while being guided in a state in which the lower guide portion 27*b* provided integrally with the cleaning device frame 27 of the process cartridge 7 is placed on the lower mounting guide 81 provided in the apparatus main assembly 100A. The lower mounting guide 81 is a mounting member for detachably mounting the process cartridge 7.

Part (b) of FIG. 7 is a schematic view for illustrating a state in which the process cartridge 7 is being mounted into the apparatus main assembly 100A and a state immediately before completion of the mounting.

Of the lower mounting guide 81 provided in the apparatus main assembly 100A, at a downstream end portion with respect to a mounting direction (the arrow E direction), an inclined portion 81*a* inclined upward with a distance closer to the downstream end with respect to the mounting direction is provided. Further, of the cleaning device frame 27, at an upstream end portion with respect to the mounting direction, an inclined portion 27*c* inclined downward with a distance closer to the upstream end with respect to the mounting direction is provided.

When the process cartridge 7 is mounted in the apparatus main assembly 100A, the lower guide portion 27*b* of the cleaning device frame 27 moves upward along the inclined portion 81*a* and the inclined portion 27*c* rides on the lower mounting guide 81. As a result, the process cartridge 7 is moved in a direction (upward direction) in which the process cartridge 7 approaches the intermediary transfer unit 5.

Part (c) of FIG. 7 is a schematic view for illustrating a state in which the process cartridge 7 is mounted in the apparatus main assembly 100A.

In the state in which the process cartridge 7 is moved in the direction in which the process cartridge 7 approaches the intermediary transfer unit 5, when the mounting of the process cartridge 7 is continued, an abutment portion 27*d* provided integrally with the cleaning device frame 27 contacts the rear side plate 83 of the apparatus main assembly 100A. By this contact, the mounting of the process cartridge 7 in the apparatus main assembly 100A is completed.

In this state, a portion to be urged 11*a* of the rear drum bearing 11 contacts a rear urging member 91 provided on the rear side plate 83, thus being pushed upward by an urging spring 92. Further, a cartridge positioning portion 11*b* provided at an upper portion of the rear drum bearing 11 contacts an abutment portion (positioning portion) 83*a* of the rear side plate 83, so that a position of the process cartridge 7 relative to the apparatus main assembly 100A is determined.

Further, a portion to be pulled 10*a* of the front drum bearing 10 is engaged with a pulling member 93 provided on the front side plate 82. By a tension spring 94 provided on the front side plate 82, the pulling member 93 is raised (moved upward), with the result that the portion to be pulled 10*a* is also raised.

Further, an abutment portion (positioning portion) 10*b* of the front drum bearing 10 contacts a developing portion 82*b* of the front side plate 82, so that the process cartridge 7 is positioned relative to the apparatus main assembly 100A in the front side.

Further, when the process cartridge 7 is demounted (taken out) from the apparatus main assembly 100A, a reverse procedure of the above-described procedure is performed.

Here, a conventional process cartridge will be described with reference to FIGS. 8 and 9.

FIG. 8 is a schematic perspective view of the conventional process cartridge. FIG. 9 is a schematic sectional view, of a longitudinal central portion of the conventional process cartridge, showing a state in which the conventional process cartridge demounted from the apparatus main assembly is gripped (grasped) by the user. In the conventional cartridge shown in FIGS. 8 and 9, constituent portions (means) which are the same as those in the process cartridge in this embodiment will be represented by the same reference numerals or symbols for convenience of explanation.

In the conventional process cartridge, as shown in FIG. 8, ribs 38*d* were provided over the entire area of the outer wall surface 31*c* in order to prevent deformation of the outer wall surface 31*c* and thus a method of enhancing the strength of the entire outer wall surface 31*c* was employed.

On the ribs 38, a label 40 is bonded.

As shown in FIG. 9, even when the strength of the outer wall surface 31*c* was enhanced, an inner pressure of the developing unit 4 was increased by deformation of the outer wall surface 31*c* when the user gripped the outer wall surface 31*c* of the developing unit 4, so that the toner T was leaked from the contact portion between the leakage-preventing sheet 20 and the developing roller 25 in some cases.

FIG. 10 is a schematic sectional view, of the longitudinal central portion of the process cartridge 7 in this embodiment, showing a state in which the user grips the process cartridge 7 demounted from the apparatus main assembly 100A.

In this embodiment, as shown in FIG. 10, the developing sheet 18 is bonded to the outer wall surface 31*c* of the developing device frame 31 so as to cover the central recess 38*c* provided in the outer wall surface 31*c* of the developing device frame 31. Then, when the user grips the developing unit 4 with his (her) hand (fingers) 99, the user's hand 99 is put on the developing sheet 18.

At this time, by the presence of the central recess 38*c* provided in the outer wall surface 31*c*, the developing sheet 18 bonded to the outer wall surface 31*c* can be flexed. Further, amounts of flexure of a bottom wall of the central recess 38*c* (in the back side of the bottom wall, an inner wall surface 31*i* described later is provided) and the above-described sheet member when the user's fingers are put on the developing sheet 18 in order to mount and demount the process cartridge are constituted as follows. That is, the amount of flexure of the developing sheet 18 is constituted so as to be larger than the amount of flexure of the bottom wall.

As a result, even in the case where a force is applied to the developing device frame 31 by the user's hand 99 when the user grips the developing unit 4, a degree of transmission of the force to the outer wall surface 31*c* can be reduced, so that the outer wall surface 31*c* can be prevented from being deformed.

Therefore, by the flexure of the developing sheet 18, the force applied to the outer wall surface 31*c* can be reduced and therefore leakage of the toner T from the developing unit 4 can be prevented.

Here, in the conventional process cartridge, the force of the user's hand 99 was locally applied to the developing device frame 31. On the other hand, in this embodiment, in the case where the force is applied to the developing sheet 18 by the user's hand 99 (in the case where the user grips the developing sheet 18), the developing sheet 18 is flexed and thus the force can be absorbed by the developing sheet 18, so that the force can be dispersed over a mounting portion, of the outer wall surface 31*c*, where the developing sheet 18 is mounted (bonded). As a result, in the case where the force is applied to the user's hand 99, the degree of the transmission of the force to the outer wall surface 31*c* can be reduced and thus the deformation of the outer wall surface 31*c* can be prevented.

Next, a measuring method of the amount of deformation (amount of flexure) of the developing sheet 18 and the outer wall surface 31*c* will be described.

FIGS. 11 and 12 are schematic sectional views for illustrating the measuring method of the deformation amount of the developing sheet 18 and the outer wall surface 31*c* in this embodiment.

As shown in FIGS. 11 and 12, the developing sheet 18 is pressed in an arrow F direction (perpendicular to the developing sheet 18) in the figures by a gauge head 60 having the same size as an end of, e.g., a test finger (in accordance with IEC (International Electrotechnical Commission) 60950).

Then, a dial gauge 61 is contacted to the developing sheet 18, and a dial gauge 62 is contacted to the inner wall surface 31*i* (constituting the developing chamber 31*b*) which is the back-side surface of the bottom wall of the central recess 38*c* of the outer wall surface 31*c*, so that the respective deformation amounts are measured.

By such a measuring method, it is possible to confirm that the deformation amount of the developing sheet 18 is larger than the deformation amount of the outer wall surface 31*c*.

As described above, according to this embodiment, the developing sheet 18 is flexed when the user grips the developing unit 4, so that the degree of the deformation of the outer wall surface 31*c* of the developing device frame 31 can be reduced and thus the inner pressure of the developing chamber 31*c* can be prevented from being increased. Therefore, it is possible to prevent the leakage of the toner T from the contact portion between the developing roller 25 and the leakage-preventing sheet 20. Incidentally, in order that the user can hold (grip) the developing sheet 18 at a position above the central recess 38*c*, the central recess 38*c* may desirably be 3 cm or more in longitudinal size (length), more desirably 5 cm or more, further desirably 10 cm or more.

Another Embodiment

FIG. 13 is a schematic sectional view of a process cartridge in another embodiment.

In the above-described embodiment, as the sheet member, the developing sheet 18 fixed on the developing device frame 31 is described but the sheet member is not limited thereto. The sheet member may also be a cleaning sheet 19 provided, as an operation label, on the cleaning device frame 27 as shown in FIG. 13. The cleaning sheet 19 is provided on the outer wall of the cleaning device frame 27 so as to cover a cleaning device frame recess 39.

Also with respect to such a cleaning sheet 19, by employing the same constitution as the above-described constitution, it is possible to prevent the removed toner collected in the removed toner chamber 27*a* of the cleaning device frame 27 from being leaked from the receptor sheet 21. In such a case, the removed toner chamber 27*a* corresponds to the accommodating portion. Incidentally, in order that the user can hold (grip) the cleaning sheet 19 at a position above the cleaning device frame recess 39, the cleaning device frame recess 39 may desirably be 3 cm or more in longitudinal size (length), more desirably 5 cm or more, further desirably 10 cm or more.

Further, in the above-described embodiment, the central recess 38*c* was provided in the outer wall surface 31*c*, so that the developing sheet 18 covering the central recess 38*c* was capable of being flexed. However, when the constitution is such that a space (recess) in which the developing sheet 18 can be flexed at the time of mounting the developing sheet 18 on the outer wall surface 31*c* is present, the constitution may also be not required to be such that the central recess 38*c* is not provided in the outer wall surface 31*c*.

Further, in the embodiments described above, four process cartridges are used, but the number of the process cartridges used is not limited to four but may also be appropriately changed as desired.

Further, in the embodiments described above, the process cartridge 7 in which the developing unit 4 as the developing device and the drum unit 26 as the cleaning device are integrally constituted is described but the process cartridge is not limited to such a process cartridge 7. When the cartridge is provided detachably mountably to the image forming apparatus main assembly and includes the accommodating portion for accommodating the toner, the present invention can be suitably applied to the cartridge. The cartridge may include the developing device or the cleaning device.

Further, in the above-described embodiments, the transfer belt is disposed on the process cartridges but the arrangement of the transfer belt is not limited thereto.

Further, in the above-described embodiments, the printer is described as the image forming apparatus as the example but the image forming apparatus is not limited to the printer. Examples of the image forming apparatus may also include a copying machine, a facsimile machine and a multi-function machine having functions of these machines.

Further, in the embodiments described above, the image forming apparatus having the constitution in which the intermediary transfer member is used, and the respective color toner images are successively transferred superposedly onto the intermediary transfer member and then are collectively transferred from the intermediary transfer member onto the recording material is described as the example, but the image forming apparatus is not limited thereto. For example, even an image forming apparatus having a constitution in which a recording material carrying member is used and the respective color toner images are successively transferred superposedly onto the recording material carried by the recording material carrying member may also be employed.

By applying the present invention to these image forming apparatuses, effects similar to those achieved in the above-described embodiments can be obtained.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 137418/2011 filed Jun. 21, 2011 and 128948/2012 filed Jun. 6, 2012, which are hereby incorporated by reference.

What is claimed is:

1. A cartridge detachably mountable to a main assembly of an image forming apparatus, comprising:

a developer accommodating chamber for accommodating a developer;

a developing chamber, for accommodating the developer, having a developer carrying member and having a recess provided in an outer wall thereof; and a sheet member provided so as to form a closed space between said recess and said sheet member, wherein an end part of a bottom of said sheet member, in a direction crossing a longitudinal direction of said sheet member, is at least partially fixed to the outer wall by adhesive, and wherein said sheet member and said recess are configured so that an amount of flexure of said sheet member is larger than that of a portion of the outer wall within said recess when said cartridge is gripped at said sheet member.

2. The cartridge according to claim 1, wherein said sheet member is a label for indicating at least one of discrimination information, an operating method and color information of said cartridge.

3. The cartridge according to claim 1, wherein said recess has a size of 3 cm or more with respect to a longitudinal direction of said cartridge.

4. The cartridge according to claim 1, wherein said recess has a size of 5 cm or more with respect to a longitudinal direction of said cartridge.

5. The cartridge according to claim 1, wherein said recess has a size of 10 cm or more with respect to a longitudinal direction of said cartridge.

6. The cartridge according to claim 1, wherein said recess is provided at a central portion with respect to a longitudinal direction of said cartridge.

7. The cartridge according to claim 1, further comprising an image bearing member for bearing the electrostatic latent image.

8. The cartridge according to claim 1, further comprising a leakage-preventing sheet provided along the longitudinal direction of said sheet member.

9. The cartridge according to claim 8, wherein said sheet member is provided above a contact point of said a leakage-preventing sheet and a developing roller.

10. The cartridge according to claim 1, wherein no communication hole is provided between said developing chamber and externally thereof.

11. The cartridge according to claim 1, wherein the end part of said sheet member is parallel to a bottom wall of said recess of said developing chamber.

12. The cartridge according to claim 1, wherein said recess is partitioned by ribs.

13. The cartridge according to claim 12, wherein said ribs are bonded to said sheet member.

14. The cartridge according to claim 1, wherein said sheet member has an adhesive surface over the bottom where said sheet member is to be bonded to the outer wall.

15. The cartridge according to claim 1, wherein said sheet member and said recess are configured so that, when said cartridge is gripped at said sheet member, developer leakage from a location between a leakage-preventing sheet and said developer carrying member is prevented.

16. A cartridge detachably mountable to a main assembly of an image forming apparatus, comprising:

an image bearing member for bearing an electrostatic latent image;

a cleaning member for removing a developer on said image bearing member;

a removed developer chamber, for accommodating the developer removed by said cleaning member, having a recess provided in an outer wall thereof; and a sheet member provided so as to cover said recess, wherein an end part of said sheet member is at least partially fixed to the outer wall, and wherein said sheet member and said recess are configured so that an amount of flexure of said sheet member is larger than that of a portion of the outer wall within said recess when said cartridge is gripped at said sheet member.

17. The cartridge according to claim 16, wherein said sheet member is a label for indicating at least one of discrimination information, an operating method and color information of said cartridge.

18. The cartridge according to claim 16, wherein said recess has a size of 3 cm or more with respect to a longitudinal direction of said cartridge.

19. The cartridge according to claim 16, wherein said recess has a size of 5 cm or more with respect to a longitudinal direction of said cartridge.

20. The cartridge according to claim 16, wherein the end part of said sheet member is at least partially fixed to the outer wall by adhesive.

21. The cartridge according to claim 16, wherein the end part of said sheet member that is at least partially fixed to the outer wall is defined with respect to a direction crossing a longitudinal direction of said sheet member and parallel to a bottom wall of said recess of said removed developer chamber.

* * * * *